US007865295B2

(12) United States Patent
Tashima

(10) Patent No.: US 7,865,295 B2
(45) Date of Patent: Jan. 4, 2011

(54) FUEL INJECTION CONTROLLER OF FLEXIBLE FUEL INTERNAL COMBUSTION ENGINE

(75) Inventor: Kazuchika Tashima, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 127 days.

(21) Appl. No.: 12/237,918

(22) Filed: Sep. 25, 2008

(65) Prior Publication Data

US 2009/0082947 A1 Mar. 26, 2009

(30) Foreign Application Priority Data

Sep. 25, 2007 (JP) ..... 2007-247681

(51) Int. Cl.
*F02D 41/30* (2006.01)

(52) U.S. Cl. ..... 701/109; 701/104; 123/299; 123/674

(58) Field of Classification Search ..... 701/101–105, 701/107, 109–111, 114, 115; 123/299, 300, 123/431, 478, 480, 494, 514, 515, 575, 674, 123/675, 698, 699, 703
See application file for complete search history.

(56) References Cited

U.S. PATENT DOCUMENTS 4,993,386 A * 2/1991 Ozasa et al. ..... 123/25 J
5,188,087 A * 2/1993 Saito ..... 123/568.21
5,231,969 A * 8/1993 Suga ..... 123/685
6,257,174 B1 * 7/2001 Huff et al. ..... 123/1 A
2008/0312810 A1 * 12/2008 Nonoyama ..... 701/111
2009/0024304 A1 * 1/2009 Takubo ..... 701/103
2009/0030588 A1 * 1/2009 Yamashita ..... 701/103

FOREIGN PATENT DOCUMENTS

| | | |
|---|---|---|
| JP | 4-116234 | 4/1992 |
| JP | 5-10163 | 1/1993 |
| JP | 5-66261 | 9/1993 |
| JP | 8-270520 | 10/1996 |
| JP | 2005-42649 | 2/2005 |

* cited by examiner

*Primary Examiner*—Stephen K Cronin
*Assistant Examiner*—Johnny H Hoang
(74) *Attorney, Agent, or Firm*—Oblon, Spivak, McClelland, Maier & Neustadt, L.L.P.

(57) ABSTRACT

A fuel injection controller includes a correcting section that performs a concentration learning procedure in which a concentration of the alcohol of the fuel in a fuel tank is learned as a learned concentration value based on a detection value of the oxygen concentration sensor, and also corrects a fuel injection amount of an injector connected to a delivery pipe in correspondence with the learned concentration value in such a manner that an air-fuel ratio corresponding to a stoichiometric air-fuel ratio is obtained. A refueling detecting section detects that refueling has been carried out to the fuel tank, and a restricting section performs a restricting procedure in which returning of the fuel from the delivery pipe to the fuel tank through a return passage is restricted on condition that the refueling detecting section has detected that the refueling has been performed.

7 Claims, 6 Drawing Sheets

FUEL INJECTION CONTROLLER OF FLEXIBLE FUEL INTERNAL COMBUSTION ENGINE

FIELD OF THE INVENTION

The present invention relates to a fuel injection controller of a flexible fuel internal combustion engine using fuel containing alcohol.

BACKGROUND OF THE INVENTION

Japanese Laid-Open Patent Publication No. 4-116234 discloses, as one type of internal combustion engine, a flexible fuel internal combustion engine that is capable of using fuel containing alcohol, which is prepared by blending alcohol with gasoline at a given ratio. The content of carbon atoms in the alcohol is different from the content of carbon atoms in normal fuel such as gasoline. It is thus necessary for the flexible fuel engine to regulate the fuel injection amount depending on which type of alcohol is blended with the gasoline and in correspondence with the concentration of the alcohol. The stoichiometric air-fuel ratio of a blended fuel containing ethanol is smaller than the stoichiometric air-fuel ratio of the gasoline. Thus, if the blended fuel containing ethanol is used, the injection amount of the blended fuel must be increased to such a value that the oxygen concentration of the exhaust gas generated from the blended fuel becomes equal to the oxygen concentration of the exhaust gas produced through combustion of the gasoline by the stoichiometric air-fuel ratio. Specifically, by correcting the fuel injection amount in correspondence with the alcohol concentration, sufficient purification performance of a catalyst device provided in an exhaust passage is ensured and deterioration of the properties of the exhaust gas is suppressed. To perform such correction of the fuel injection amount, the flexible fuel engine learns the alcohol concentration of the blended fuel using a detection value of an oxygen concentration sensor arranged in the exhaust passage. The engine operates to correct the fuel injection amount based on a learned value.

However, the alcohol concentration of the fuel combusted by the flexible fuel engine may be inconstant. In other words, the engine may receive a blended fuel with an alcohol concentration different from that of the fuel currently retained in the fuel tank. In other words, in operation of the engine after refueling, the alcohol concentration of the blended fuel significantly changes. Nonetheless, once a learning procedure of the alcohol concentration is completed, the fuel injection amount may be corrected in correspondence with the current alcohol concentration of the fuel even after the alcohol concentration of the blended fuel retained in the fuel tank has changed. However, the learning procedure of the alcohol concentration cannot be resumed unless a prescribed condition is satisfied so that the accuracy of the learning procedure is ensured. Further, even if the condition is met and the learning procedure is started, a certain amount of time is necessary before the procedure is completed. That is, if the alcohol concentration of the blended fuel changes due to the refueling, the engine cannot perform correction of the fuel injection amount in correspondence with the alcohol concentration until after the predetermined time elapses. This deteriorates the air-fuel ratio.

SUMMARY OF THE INVENTION

Accordingly, it is an objective of the present invention to provide a fuel injection controller of a flexible fuel internal combustion engine that prevents deterioration of the air-fuel ratio after a blended fuel with a different alcohol concentration is fed to the engine.

To achieve the foregoing objective and in accordance with one aspect of the present invention, a fuel injection controller of a flexible fuel internal combustion engine is provided. The controller has a main passage through which fuel containing alcohol is fed from a fuel tank to a delivery pipe by a fuel pump, and a return passage through which the fuel is returned from the delivery pipe to the fuel tank. The controller includes an oxygen concentration sensor, a correcting section, a refueling detection section, and a restricting section. The oxygen concentration sensor is arranged in an exhaust passage of the engine. The correcting section performs a concentration learning procedure in which a concentration of the alcohol of the fuel in the fuel tank is learned as a learned concentration value based on a detection value of the oxygen concentration sensor. The correcting section corrects a fuel injection amount of an injector connected to the delivery pipe in correspondence with the learned concentration value in such a manner that an air-fuel ratio corresponding to a stoichiometric air-fuel ratio is obtained. The refueling detecting section detects that refueling has been carried out to the fuel tank. The restricting section performs a restricting procedure in which returning of the fuel from the delivery pipe to the fuel tank through the return passage is restricted on condition that the refueling detecting section has detected that the refueling has been performed.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1 to 6B.

Figure 1:
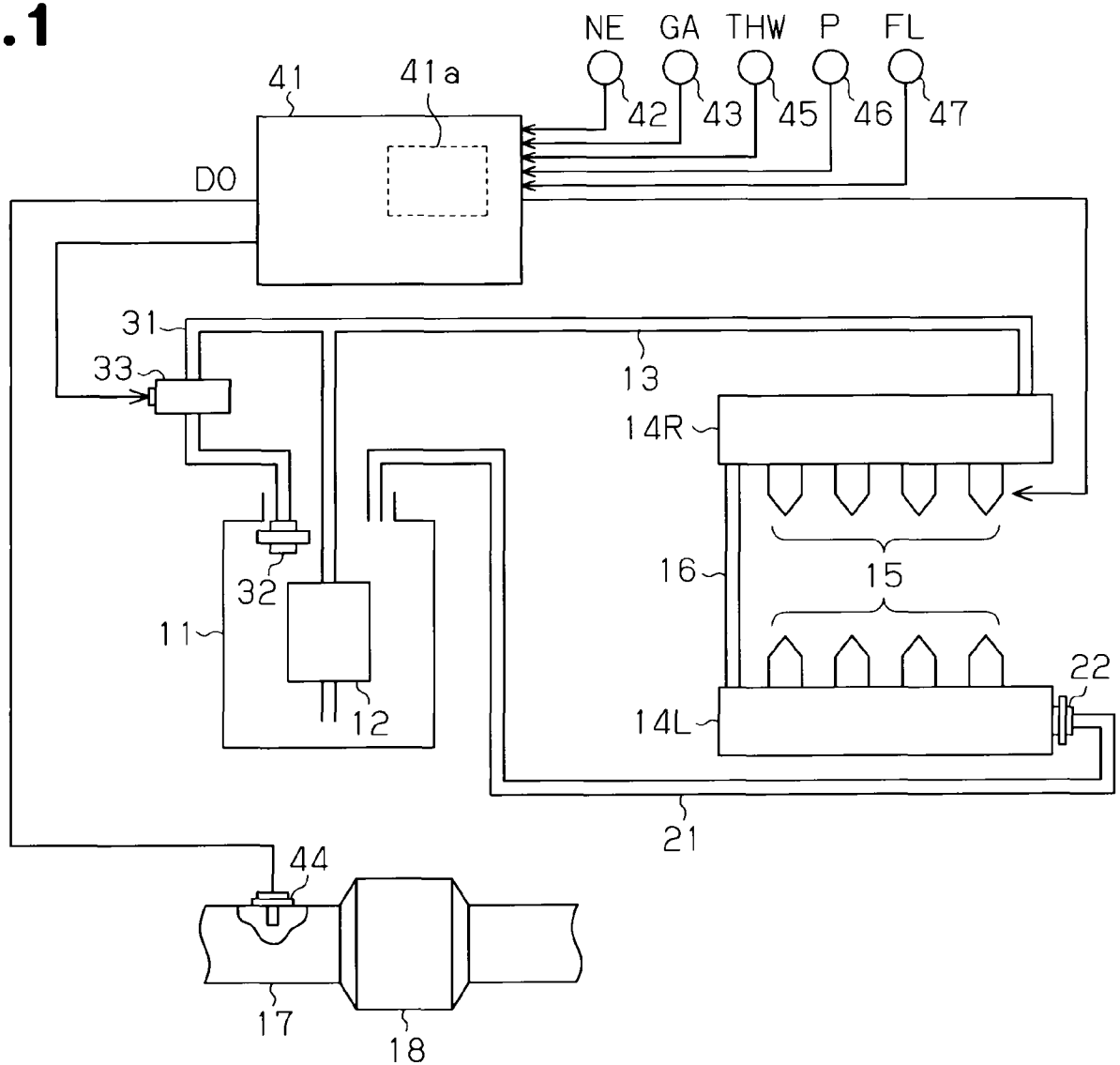
FIG. 1 is a diagram schematically representing a fuel injection controller according to one embodiment of the present invention.

FIG. 1 diagrammatically illustrates the configuration of an on-vehicle V8 internal combustion engine, and a fuel injection controller of the engine. With reference to the diagram, the engine includes a pair of banks each having a plurality of cylinders. A pair of delivery pipes 14R, 14L are provided in the engine in correspondence with the two banks. Four injectors 15 are connected to each of the delivery pipes 14R, 14L in correspondence with the cylinders. The engine is a flexible fuel internal combustion engine capable of operating by combusting blended fuel prepared by blending alcohol with gasoline as fuel. In the present embodiment, the flexible fuel internal combustion engine uses blended fuel prepared by blending ethanol with gasoline. The ethanol concentration of the blended fuel is changed according to the history of refueling, in other words, in correspondence with the ethanol concentration of the blended fuel retained in a fuel tank 11 and the ethanol concentration of the blended fuel supplied to the fuel tank 11 by the refueling. Specifically, the ethanol concentration of the blended fuel changes from 0% (fuel consisting solely of gasoline) to 85%.

A fuel pump 12 is arranged in the fuel tank 11. The fuel pump 12 is connected to a first delivery pipe 14R through a main pipe 13 (a main passage). The first delivery pipe 14R is connected to a second delivery pipe 14L through a communication pipe 16. A high-pressure regulating valve 22 is provided in the second delivery pipe 14L to adjust the fuel pressure in each one of the delivery pipes 14R, 14L, or fuel injection pressure P, to a high level. The second delivery pipe 14L is connected to a high-pressure return pipe 21, which functions as a return passage and a high-pressure return passage, through the high-pressure regulating valve 22.

A low-pressure return pipe 31 (a low-pressure return passage) is branched from the main pipe 13 at a position adjacent to the fuel tank 11 and extends to the fuel tank 11. A low-pressure regulating valve 32 is provided in the low-pressure return pipe 31 to adjust the fuel pressure in the delivery pipes 14R, 14L to a low level. The valve opening pressure PL of the low-pressure regulating valve 32 is lower than the valve opening pressure PH of the high-pressure regulating valve 22 (PL<PH). A fuel pressure switch valve 33 is provided in the low-pressure return pipe 31. The fuel pressure switch valve 33 switches the fuel in the main pipe 13 between a state in which the fuel is permitted to flow into the low-pressure return pipe 31 and a state in which the fuel cannot flow to the low-pressure return pipe 31.

Specifically, when the fuel pressure switch valve 33 is in a closed state, the fuel cannot flow from the main pipe 13 into the low-pressure return pipe 31. As a result, the entire amount of the fuel that has been fed from the fuel pump 12 to the main pipe 13 is sent to the delivery pipes 14R, 14L under pressure. When the fuel pressure in the delivery pipes 14R, 14L becomes higher than the valve opening pressure PH of the high-pressure regulating valve 22, the high-pressure regulating valve 22 becomes open. This returns the fuel to the fuel tank 11 through the high-pressure return pipe 21. As a result, the fuel injection pressure P is maintained at a level substantially equal to the valve opening pressure PH of the high-pressure regulating valve 22.

Contrastingly, when the fuel pressure switch valve 33 becomes open, the fuel flows from the main pipe 13 into the low-pressure return pipe 31. If the fuel pressure in the delivery pipes 14R, 14L rises and the low-pressure regulating valve 32 opens prior to the high-pressure regulating valve 22, some of the fuel is sent back to the fuel tank 11 through the low-pressure return pipe 31 without being fed to the delivery pipes 14R, 14L. This maintains the fuel injection pressure P at a level substantially equal to the valve opening pressure PL of the low-pressure regulating valve 32. As has been described, in the fuel injection controller according to the present embodiment, the fuel injection pressure P is changed by switching the fuel pressure switch valve 33. Further, basically, in a period (A) from when the engine is started to when a predetermined time elapses and a state (B) in which high load acts on the engine, the fuel pressure switch valve 33 is switched to a closed state. As a result, the fuel injection pressure P becomes a relatively high value (=PH). This is because, in the period (A) and the state (B), an increased amount of fuel must be injected. Also, since the heat of combustion of ethanol is lower than that of gasoline, the injection amount of the fuel must be further increased. In contrast, in a period other than (A) or a state other than (B), the fuel pressure switch valve 33 is basically switched to an open state. The fuel injection pressure P thus becomes a relatively low value (=PL).

The engine also includes various sensors that obtain different types of information such as the engine operating state. For example, an engine speed sensor 42 is arranged in the vicinity of a non-illustrated crankshaft to detect the rotational speed of a crankshaft, which is the engine speed NE.

An intake air amount sensor 43 for detecting the intake air amount GA is provided in a non-illustrated intake pipe, which is connected to the engine. A three-way catalyst 18 is provided in an exhaust pipe (an exhaust passage) 17 and an oxygen concentration sensor 44 is located upstream from the three-way catalyst 18 in the exhaust pipe 17. The oxygen concentration sensor 44 outputs a signal changing continuously in correspondence with the oxygen concentration DO of the exhaust gas in the exhaust pipe 17. If the temperature of a detection element of the oxygen concentration sensor 44 is lower than a predetermined activation level, the oxygen concentration sensor 44 is incapable of detecting the oxygen concentration DO with high accuracy. Thus, the oxygen concentration sensor 44 incorporates a heater that heats the detection element to the activation level when the temperature of the exhaust gas or the atmospheric temperature is low. A coolant temperature sensor 45 is arranged in a water jacket of a non-illustrated cylinder block to detect the engine coolant temperature THW. Since the engine coolant temperature THW changes in correlation with the engine temperature or the fuel temperature, the value THW is used as a substitute of these temperatures. Also, a fuel pressure sensor 46 is formed in the second delivery pipe 14L to detect the fuel injection pressure P. Further, a fuel amount sensor 47 is provided in the fuel tank 11 to detect the fuel amount FL in the fuel tank 11.

Detection signals of the sensors 42 to 47 are provided to an electronic control unit (ECU) 41 of the engine. The ECU 41 includes a memory section 41*a*, which stores various control programs, calculation maps, and data obtained in execution of various types of control. The ECU 41 thus functions as a correcting section, a refueling detecting section, a restricting section, an estimating section, a inhibiting section, an initializing section, and a control section. The memory section 41*a* has a ROM, a RAM, and a backup RAM. The backup RAM is capable of maintaining the stored content while powered by a non-illustrated battery even after the engine is stopped, or the power supply to the ECU 41 is suspended. The ECU 41 executes controls related to fuel injection such as regulation of the fuel injection amount, the fuel injection pressure, and the fuel circulation mode, by operating an injector 15, the fuel pressure switch valve 33 or the like in correspondence with the detection signals provided by the sensors including the sensors 42 to 47.

Fuel injection control executed by the ECU 41 will hereafter be explained with reference to FIGS. 2 to 6.

First, a fuel injection amount calculating procedure, or a procedure for calculating the amount of the fuel injected by the injector 15, will be described in accordance with the flowchart of FIG. 2. A series of procedures represented by the flowchart is repeatedly performed by the ECU 41 at predetermined cycles.

Figure 2:
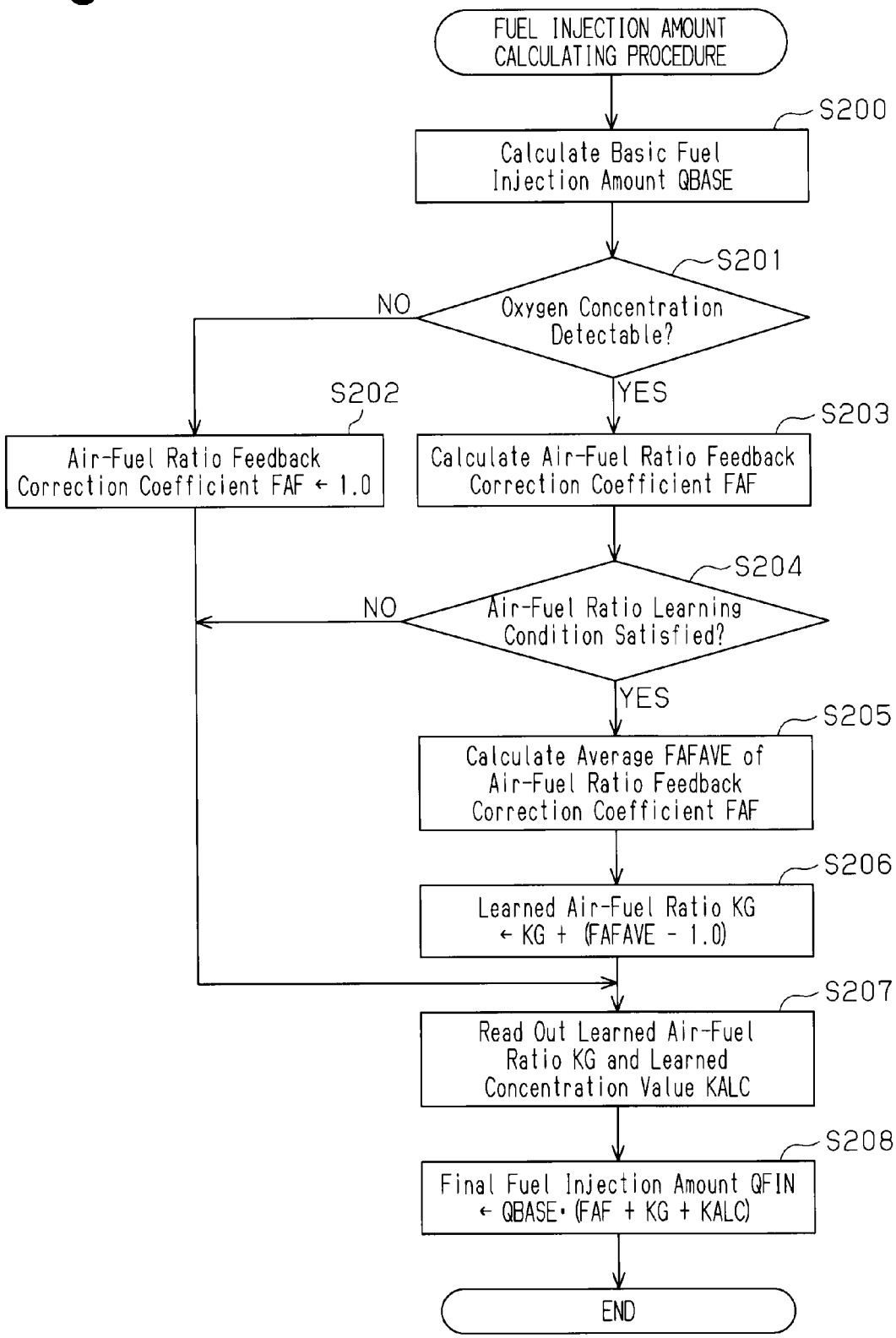
FIG. 2 is a flowchart representing a fuel injection amount calculating procedure carried out by the fuel injection controller represented in FIG. 1.

With reference to FIG. 2, the basic fuel injection amount QBASE is calculated using the engine speed NE and the engine load obtained from the engine speed NE and the intake air amount GA (step S200).

It is then determined whether the oxygen concentration sensor 44 is capable of detecting the oxygen concentration DO of the exhaust gas (step S201). As has been described, when the temperature of the detection element of the oxygen concentration sensor 44 is lower than the predetermined activation level, the oxygen concentration sensor 44 is incapable of detecting the oxygen concentration DO with high accuracy. Accordingly, it is determined that the oxygen concentration sensor 44 is capable of detecting the oxygen concentration DO if the detection element of the oxygen concentration sensor 44 is higher than or equal to the activation level.

If it is determined that the oxygen concentration DO is detectable (step S201: YES), the air-fuel ratio feedback correction coefficient FAF is calculated based on the oxygen concentration DO detected by the oxygen concentration sensor 44. The air-fuel ratio feedback correction coefficient FAF is used for compensating for a temporary difference between the oxygen concentration DO1 of the exhaust gas produced through combustion of gasoline by the stoichiometric air-fuel ratio and the oxygen concentration DO of actual exhaust gas.

After the air-fuel ratio feedback correction coefficient FAF is obtained (step S203), it is determined whether a condition for learning the air-fuel ratio is satisfied (step S204). The condition may be, for example, that the vehicle is in neither acceleration nor deceleration and the engine is in steady operation, or that the absolute value of the value obtained by subtracting 1.0 from the air-fuel ratio feedback correction coefficient is maintained greater than a predetermined value continuously for a predetermined time.

If it is determined that the condition for learning the air-fuel ratio is satisfied (step S204: YES), the average FAFAVE of the air-fuel ratio feedback correction coefficient FAF in a predetermined period of time is calculated (step S205).

Subsequently, a new learned air-fuel ratio value KG is calculated by adding the value obtained by subtracting 1.0 from the average FAFAVE to the current learned air-fuel ratio value KG (step S206). The newly obtained learned air-fuel ratio value KG is stored in the backup RAM of the memory section 41*a*. Each time the learned air-fuel ratio value KG is updated, the air-fuel ratio feedback correction coefficient FAF is set to 1.0, which is the initial value of the air-fuel ratio feedback correction coefficient FAF.

The learned air-fuel ratio value KG and the learned concentration value KALC, which will be described later, are then read out from the backup RAM of the memory section 41*a* (step S207).

If it is determined that the oxygen concentration sensor 44 is incapable of detecting the oxygen concentration DO of the exhaust gas (step S201: NO), the air-fuel ratio feedback correction coefficient FAF is set to 1.0 (step S202). Then, the learned air-fuel ratio value KG and the learned ethanol concentration value KALC are read out (step S207). These values KG and KALC are read out (step S207 is performed) also when it is determined that the condition for learning the air-fuel ratio is not satisfied (step S204: NO).

The learned values KG, KALC and the air-fuel ratio feedback correction coefficient FAF are then added. The added value of the obtained value and the basic fuel injection amount QBASE is calculated as the final fuel injection amount QFIN (step S208).

After the final fuel injection amount QFIN is determined, the current cycle of the procedure is suspended.

The fuel injection time TAU, or the valve opening time of the injector 15, is calculated based on the final fuel injection amount QFIN, which is obtained through the fuel injection amount calculating procedure, and the fuel injection pressure P detected by the fuel pressure sensor 46. The ECU 41 outputs a signal for opening the valve of the injector 15 in correspondence with the fuel injection time TAU to the injector 15. This causes the injector 15 to inject the fuel by the amount corresponding to the final fuel injection amount QFIN.

As has been described, the flexible fuel internal combustion engine according to the present embodiment uses the blended fuel containing ethanol having a stoichiometric air-fuel ratio smaller than that of gasoline. It is thus necessary to correct the fuel injection amount to a greater value in such a manner that the oxygen concentration DO of the exhaust gas produced from the blended fuel becomes equal to the oxygen concentration DO of the exhaust gas produced through combustion of the gasoline by the stoichiometric air-fuel ratio. Such correction ensures sufficient purification performance of the three-way catalyst 18, which is provided in the exhaust pipe 17, suppressing deterioration of the properties of the exhaust gas. In other words, the ECU 41 of the present embodiment estimates and learns the ethanol concentration of the fuel using the detection value of the oxygen concentration sensor 44 in the exhaust pipe 17 and corrects the fuel injection amount in correspondence with the thus learned value.

An ethanol concentration learning procedure will hereafter be explained with reference to FIGS. 3 to 4B.

Figure 3:
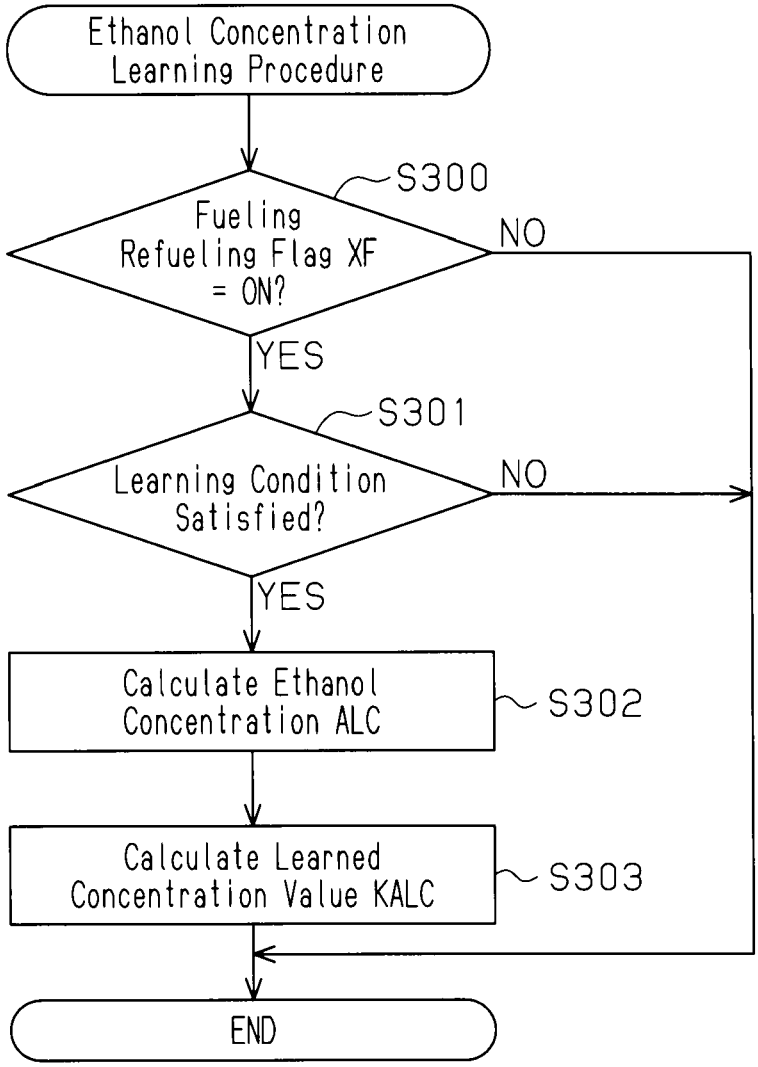
FIG. 3 is a flowchart representing an ethanol concentration learning procedure of the fuel performed by the fuel injection controller represented in FIG. 1.

FIG. 3 is a flowchart representing the ethanol concentration learning procedure. A series of procedure represented by the flowchart is repeatedly performed by the ECU 41 at predetermined cycles. While the ethanol concentration learning procedure is being carried out, the air-fuel ratio learning steps (steps S203 to S207) of the fuel injection amount calculating procedure is inhibited from being performed.

With reference to FIG. 3, after the fuel is fed to the fuel tank 11, it is determined whether learning of the ethanol concentration ALC has yet to be completed (step S300) first in the procedure. Specifically, if the refueling flag XF is "ON", it is determined that learning of the ethanol concentration ALC has yet to be completed since refueling to the fuel tank 11 has been started. The refueling flag XF is set to "ON" if the fuel amount FL in the fuel tank 11 has increased by an amount greater than or equal to a predetermined value. Afterwards, when learning of the ethanol concentration ALC is completed, the refueling flag XF is set to "OFF".

If is determined that the refueling flag XF is "OFF" (step S300: NO), the current cycle of the procedure is suspended.

Contrastingly, if it is determined that refueling has been carried out (step S300: YES), it is then determined whether a condition for learning the ethanol concentration is satisfied (step S301). The condition for learning the ethanol concentration is determined to be satisfied if the following conditions (1) and (2) are met.

(1) The oxygen concentration sensor 44 is in an activated state.

(2) The absolute value of the air-fuel ratio feedback correction coefficient FAF is unequal to 1.0.

If it is determined that the condition for learning the ethanol concentration is not yet satisfied (step S301: NO), the current cycle of the procedure is suspended.

If the condition for learning the ethanol concentration is satisfied (step S301: YES), the air-fuel ratio feedback correction coefficient FAF is calculated using the detection result of the oxygen concentration sensor 44. The deviation ΔFAF between the air-fuel ratio feedback correction coefficient FAF and the initial value (=1.0) of the air-fuel ratio feedback correction coefficient FAF is then obtained. Subsequently, the ethanol concentration deviation ΔALC of the fuel is estimated based on the deviation ΔFAF. Next, the ethanol concentration ALC is calculated based on the ethanol concentration deviation ΔALC (step S302).

Figure 4A:
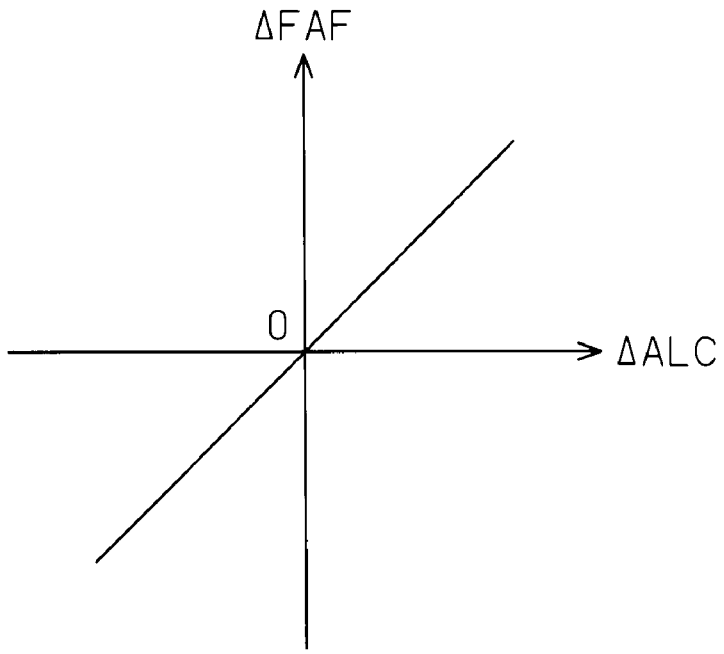
FIG. 4A is a graph representing the relationship between change of the correction coefficient and change of the ethanol concentration of fuel.
Figure 4B:
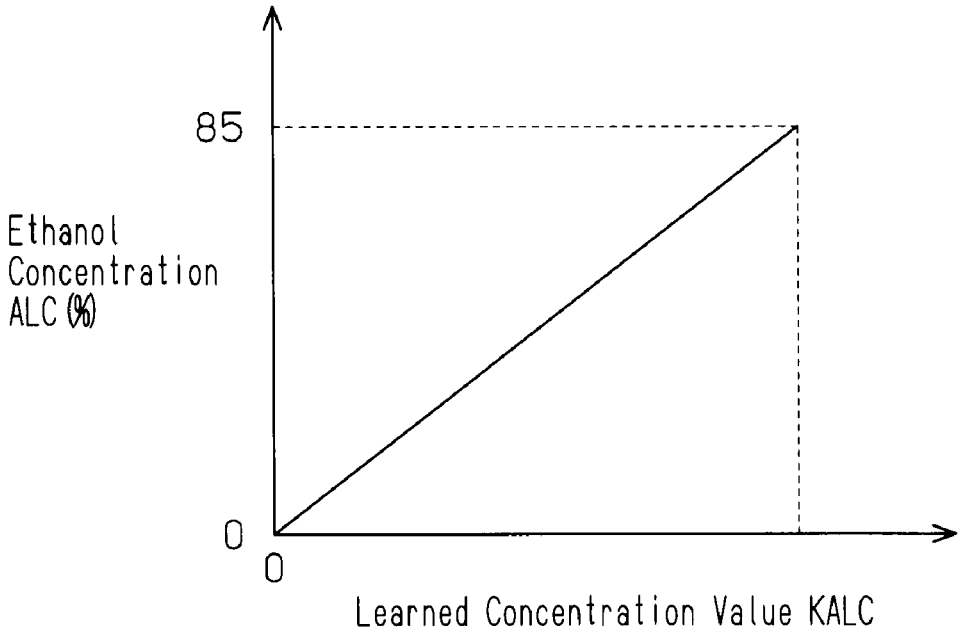
FIG. 4B is a graph representing the relationship between the ethanol concentration of fuel and a learned value of the ethanol concentration.

As illustrated in FIG. 4A, when the engine is started immediately after refueling is completed, the deviation ΔFAF between the air-fuel ratio feedback correction coefficient FAF calculated after the refueling and the initial value (=1.0) of the coefficient FAF varies in correspondence with change of the ethanol concentration. Accordingly, the ethanol concentration deviation ΔALC of the fuel is estimated based on the deviation ΔFAF of the air-fuel ratio feedback correction coefficient FAF. Then, the ethanol concentration ALC is obtained using the following expression (1).

$$ALC \leftarrow ALC + \Delta ALC \quad (1)$$

Subsequently, with reference to the calculation map represented in FIG. 4B, the learned ethanol concentration value KALC corresponding to the ethanol concentration ALC is calculated (step S303). The calculation map is generated in advance based on a result of a test or the like. The calculation map is stored in the ROM of the memory section 41*a*. The thus obtained learned ethanol concentration value KALC is stored in the backup RAM of the memory section 41*a*.

After the learned ethanol concentration value KALC is determined, the current cycle of the procedure is suspended.

As has been described, in the flexible fuel internal combustion engine, the ethanol concentration of the currently fed fuel is different from the ethanol concentration of the previously fed fuel. This changes the ethanol concentration of the fuel before and after refueling, leading to an abrupt change of the ethanol concentration of the fuel injected by the injector 15 in operation of the engine after the refueling. The conventional fuel injection controller is incapable of appropriately performing feedback correction of the fuel injection amount in correspondence with the ethanol concentration until after learning of the ethanol concentration is completed so that the ethanol concentration of the fuel after the change is accurately acquired. This deteriorates the air-fuel ratio.

However, in the fuel injection controller according to the present embodiment, the fuel pressure switch valve 33 of the low-pressure return pipe 31 is opened when refueling has been detected. This restricts returning of the fuel from the delivery pipes 14R, 14L to the fuel tank 11 via the high-pressure return pipe 21. This maximally prolongs the time in which fuel injection is performed using the blended fuel retained in the delivery pipes 14L, 14R and the main pipe 13. Accordingly, in this period, correction of the fuel injection amount is appropriately carried out based on the ethanol concentration ALC of the fuel, based on the learned ethanol concentration value KALC that has been obtained before refueling. This prevents un undesirable air-fuel ratio.

A procedure for selectively opening and closing the fuel pressure switch valve 33 will now be explained with reference to FIG. 5.

Figure 5:
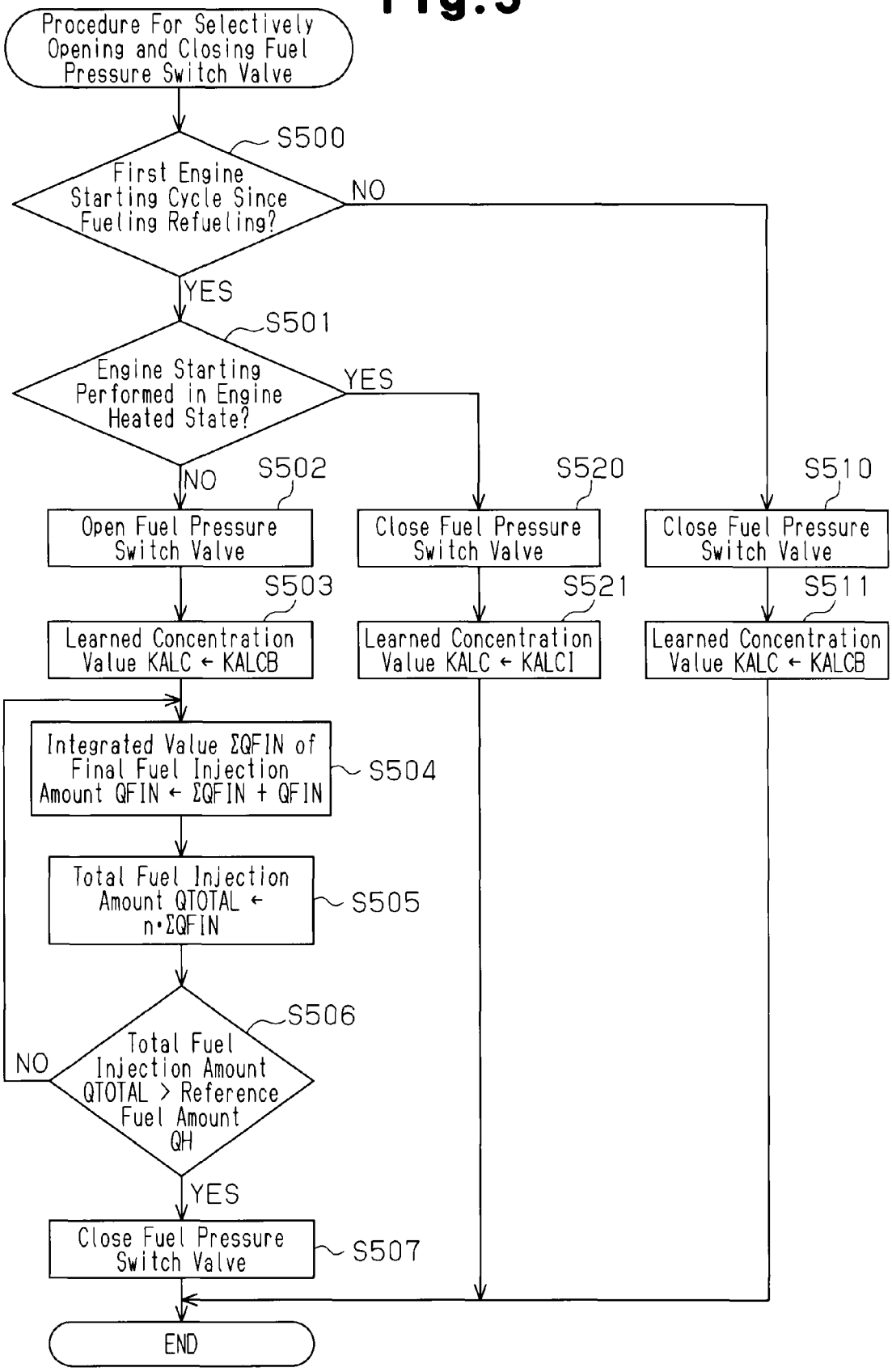
FIG. 5 is a flowchart representing a control procedure for selectively opening and closing a fuel pressure switch valve according to the illustrated embodiment.

FIG. 5 is a flowchart representing the procedure for selectively opening and closing the fuel pressure switch valve 33. A series of procedures represented by the flowchart is performed by the ECU 41 when the engine is started.

With reference to FIG. 5, it is determined whether the current cycle of engine starting is the first cycle of engine starting since refueling has been completed (step S500). Specifically, it is determined that refueling was carried out while the engine has been maintained in a stopped state if the fuel amount FL detected by the fuel amount sensor 47 in the fuel tank 11 is greater than the detection value obtained immediately before the engine has been stopped previously by an amount greater than or equal to a predetermined amount ΔFL.

If it is determined that the current cycle of engine starting is not the first cycle of engine starting since refueling has been carried out (step S500: NO), a procedure for closing the fuel pressure switch valve 33 is performed (step S510). Afterwards, the learned ethanol concentration value KALC of the fuel, which is a correction value used in calculation of the fuel injection amount, is set to the value KALCB, which has been learned in the previous engine operation (step S511). The current cycle of the procedure is thus suspended.

In contrast, if it is determined that the current cycle of engine starting is the first cycle of engine starting since refueling has been carried out (step S500: YES), it is determined whether re-starting of the engine is carried out in a heated state of the engine (step S501). Specifically, the engine coolant temperature THW is considered as the temperature of the fuel retained in the delivery pipes 14R, 14L, and the engine coolant temperature THW is detected by the coolant temperature sensor 45. If the engine coolant temperature THW is greater than or equal to a predetermined level, it is determined that the engine is in a heated state. The predetermined value is set to a value of the engine coolant temperature THW corresponding to the lower limit of the fuel temperature at which the fuel forms vapor.

If it is determined that re-starting of the engine is being performed in the engine heated state (step S501: YES), a procedure for closing the fuel pressure switch valve 33 is carried out (step S520). Subsequently, the learned ethanol concentration value KALC is set to the initial learned ethanol concentration value KALCI, which is the initial value of the learned ethanol concentration value KALC, which is the initial value of the learned ethanol concentration value KALCI (step S521). The initial learned ethanol concentration value KALCI is the average of the low-concentration learned value set when the ethanol concentration ALC has the lowest (0%) throughout the ethanol concentration learning procedure and the high-concentration learned value set when the ethanol concentration ALC is the highest (85%). After the procedure for initializing the learned ethanol concentration value KALC is accomplished, the current cycle of the procedure is suspended.

In contrast, if it is determined that the engine temperature is low (step S501: NO), the procedure for opening the fuel pressure switch valve 33 is performed (step S502). Then, the learned ethanol concentration value KALC is set to the learned ethanol concentration value KALCB that has been learned in the previous engine operation (step S503).

Once the fuel pressure switch valve 33 becomes open, the fuel pressure switch valve 33 is maintained in the open state until it is determined that the integrated value of the fuel injection amount since starting of the engine exceeds the amount of the fuel that can be retained in the main pipe 13 and the delivery pipes 14R, 14L when the engine is stopped.

Specifically, the integrated value ΣQFIN of the final fuel injection amount QFIN is calculated using the following expression (2).

$$\Sigma QFIN \leftarrow \Sigma QFIN + QFIN \quad (2)$$

Subsequently, the total fuel injection amount QTOTAL is obtained by multiplying the integrated value ΣQFIN of the final fuel injection amount QFIN by the number n (=8) of the cylinders using the following expression (3) (step S505).

$$QTOTAL \leftarrow n \cdot \Sigma QFIN \quad (3)$$

It is then determined whether the total fuel injection amount QTOTAL, which is determined using the expression (3), is greater than the reference fuel amount QTH, which is the amount of the fuel that can be retained in the main pipe 13 and the delivery pipes 14R, 14L when the engine is stopped.

If it is determined that the total fuel injection amount QTOTAL is greater than the reference fuel amount QTH (step S506: YES), the fuel pressure switch valve 33 is operated to close (step S507). The current cycle of procedure is then suspended.

Contrastingly, if it is determined that the total fuel injection amount QTOTAL is smaller than or equal to the reference fuel amount QTH (step S506: NO), the calculation of the final fuel injection amount QFIN and the total fuel injection amount QTOTAL is repeatedly carried out until the total fuel injection amount QTOTAL exceeds the reference fuel amount QTH.

Figure 6A:
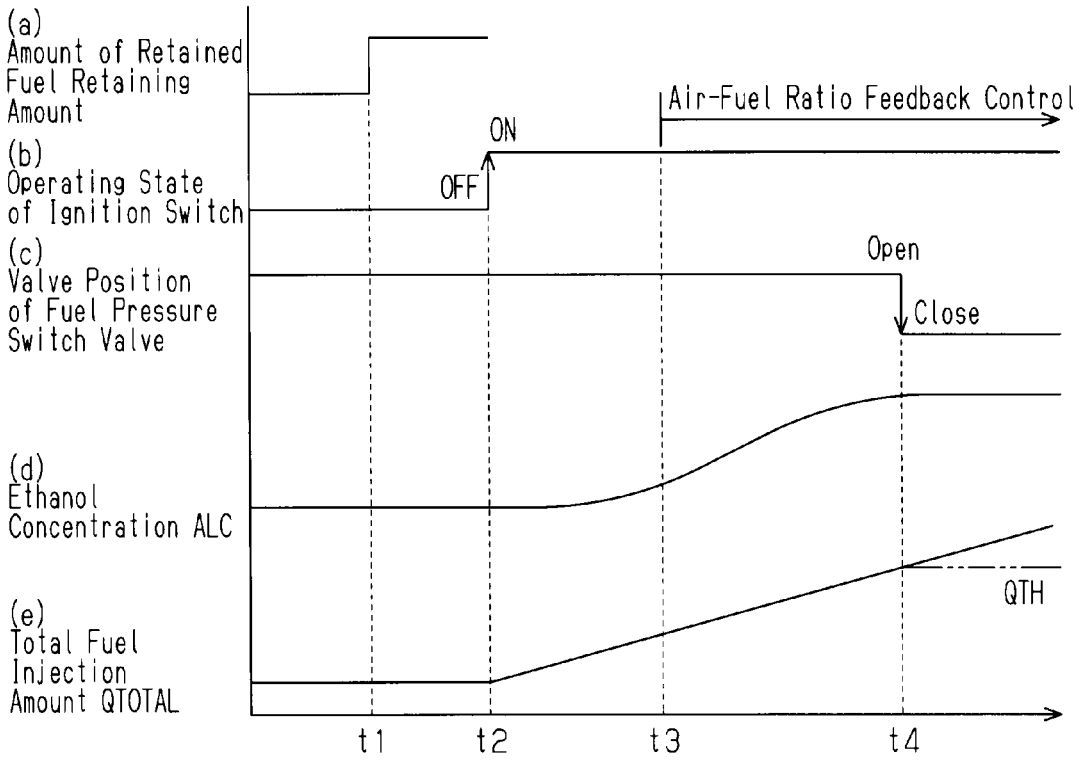
FIG. 6A is a timing chart representing an example of operation of the fuel pressure switch valve in cold re-starting of the engine.
Figure 6B:
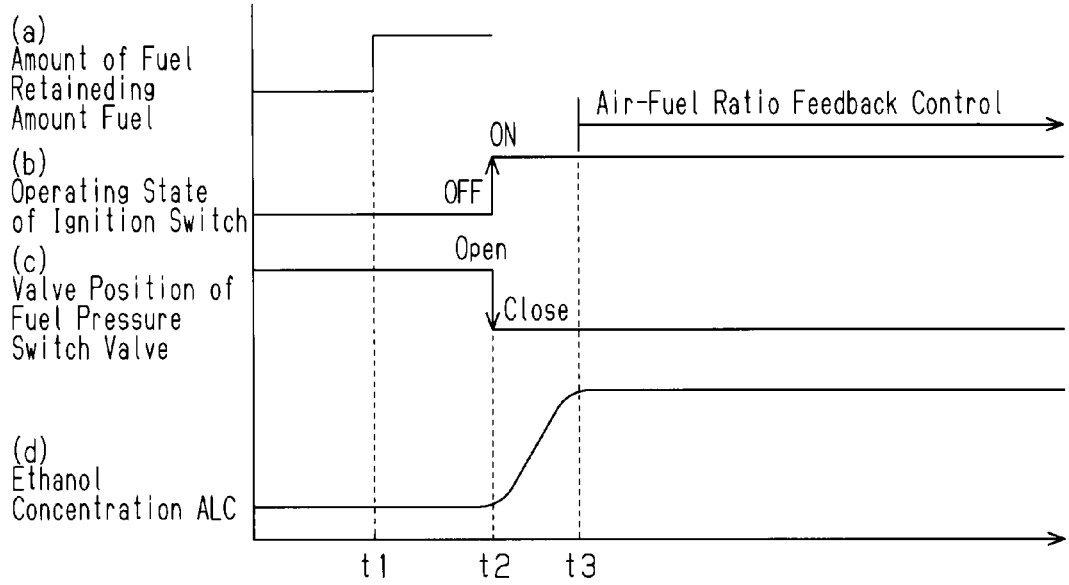
FIG. 6B is a timing chart representing an example of operation of the fuel pressure switch valve in hot re-starting of the engine.

In FIGS. 6A and 6B, by way of example, (a) represents change of the amount of retained fuel in the fuel tank 11, (b) represents change of the operating state of the ignition switch, (c) represents change of the valve position of the fuel pressure switch valve 33, (d) represents change of the ethanol concentration ALC of the fuel injected by the injector 15, and (e) represents change of the total fuel injection amount QTOTAL since re-starting of the engine, in the procedure for selectively opening and closing the fuel pressure switch valve 33, which is represented by the flowchart of FIG. 5. FIG. 6A shows an example when it is determined that the engine is re-started in a cold state (step S501: NO) in the flowchart of FIG. 5. FIG. 6B corresponds to an example when it is determined that re-starting of the engine is carried out in the heated state of the engine (step S501: YES). Also, FIGS. 6A and 6B each show an example in which the ethanol concentration ALC of the currently fed fuel is higher than the ethanol concentration ALC of the fuel that has been retained in the fuel tank 11 from before refueling.

With reference to FIG. 6A, when fuel is supplied to the flexible fuel internal combustion engine while the engine is held in a stopped state, the amount of retained fuel in the fuel tank 11 increases (at time point t1). The engine is then re-started by turning on the ignition switch and the fuel pressure switch valve 33 is maintained in an open state (at time point t2). Specifically, the fuel pressure switch valve 33 is controlled to become open when the engine is stopped and operated to maintain the open state while the engine is held in the stopped state. The total fuel injection amount QTOTAL increases since starting of the engine and, correspondingly, the ethanol concentration ALC of the fuel injected by the injector 15 rises (from time points t2 to t4). Meanwhile, the temperature of the engine increases, the oxygen concentration sensor 44 is activated, and the air-fuel ratio feedback control is started (at time point t3). Afterwards, when the total fuel injection amount QTOTAL exceeds the reference fuel amount QTH, the fuel pressure switch valve 33 is switched to a closed state (at time point t4).

FIG. 6B will be explained mainly on the differences between FIG. 6A and FIG. 6B.

With reference to FIG. 6B, when the ignition switch is turned on and the engine is re-started, the fuel pressure switch valve 33 is switched from the open state to the closed state (at time point t2). The oxygen concentration sensor 44 is then activated and the air-fuel ratio feedback control is started (at time point t3). The period of time from when the engine is started to when the air-fuel ratio feedback control is started is short compared to the case of FIG. 6A, in which starting of the engine is carried out in the cold state of the engine. However, in this period, the ethanol concentration ALC of the fuel injected by the injector 15 rapidly changes from time point t2 to time point t3.

The fuel injection controller of the flexible fuel internal combustion engine according to the present embodiment has the following advantages.

(1) In the present embodiment, when it is detected that refueling has been carried out, the ECU 41 operates to open the fuel pressure switch valve 33 in the low-pressure return pipe 31, thus connecting the low-pressure return pipe 31 to the main pipe 13. This opens the low-pressure regulating valve 32 in the low-pressure return pipe 31 before the fuel pressure in the delivery pipes 14L, 14R, or the fuel injection pressure, increases to the valve opening pressure of the high-pressure regulating valve 22 in the high-pressure return pipe 21. Some of the fuel that has been sent from the fuel pump 12 is thus returned to the fuel tank 11 through the low-pressure return pipe 31. This restricts returning of the fuel from the delivery pipes 14R, 14L to the fuel tank 11 through the high-pressure return pipe 21. As a result, fuel injection is continuously carried out for a predetermined time using the fuel retained in the delivery pipes 14R, 14L and the main pipe 13 from when refueling was carried out, for which fuel the learned ethanol concentration value KALC has been already set in correspondence with the ethanol concentration through the ethanol concentration learning procedure of the fuel. The ethanol concentration of the fuel injected by the injector 15 thus gradually shifts from the level before refueling to the level after the refueling. This prevents the ethanol concentration ALC obtained through the concentration learning procedure and the actual ethanol concentration from being significantly different from each other before the ethanol concentration learning procedure is completed. Accordingly, a deterioration of air-fuel ratio caused due to such great difference is prevented and, correspondingly, the properties of the exhaust gas are prevented from being deteriorated.

(2) The above-described restricting procedure is carried out until after a predetermined time elapses since starting of the engine. This effectively suppresses deterioration of air-fuel ratio in the starting of the engine, in which such deterioration of the air-fuel ratio tends to become pronounced.

(3) Even for the first cycle of starting of the engine after refueling has been performed, the restricting procedure is inhibited from being carried out if the temperature of the fuel in the delivery pipes 14R, 14L is greater than a predetermined level, or the level at which vapor formation of the fuel is likely to occur. By inhibiting the restricting procedure when re-starting of the engine is carried out in a heated state of the engine, some of the fuel that has been supplied from the fuel pump 12 to the delivery pipes 14R, 14L is allowed to return to the fuel tank 11 through the high-pressure return pipe 21. This also returns the vapor of the fuel from the delivery pipes 14R, 14L to the fuel tank 11 along with the fuel, thus eliminating the vapor. In this manner, the startability of the engine in the heated state is prevented from deteriorating due to the vapor formation of the fuel.

(4) When the restricting procedure is inhibited in starting of the engine in a heated state, the learned ethanol concentration value KALC of the concentration learning procedure is initialized. Specifically, the initial value KALCI is set to the average of the low-concentration learned value set when the ethanol concentration ALC has the lowest value throughout the concentration learning procedure and the high-concentration learned value set when the ethanol concentration ALC is the highest. Accordingly, unlike a case in which the low-concentration learned value or the high-concentration learned value is selected as the initial value of the learned ethanol concentration value, the ethanol concentration ALC before the learning procedure is completed is prevented from becoming significantly different from the actual ethanol concentration ALC. This prevents the air-fuel ratio from deteriorating.

(5) The restricting procedure is ended when the total fuel injection amount QTOTAL since starting of the engine exceeds the reference fuel amount QTH, or the amount of the fuel that can be retained in the main pipe 13 and the delivery pipes 14R, 14L. After the total fuel injection amount QTOTAL exceeds the reference fuel amount QTH, the fuel with the ethanol concentration ALC after refueling, which is different from the value before the refueling, is injected. In this state, it is highly likely that the ethanol concentration ALC becomes substantially constant. Accordingly, the period in which the restricting procedure is performed is prevented from being prolonged unnecessarily.

The above embodiment may be embodied in the following modified forms.

In the illustrated embodiment, it is determined that refueling was carried out while the engine was held in a stopped state if the fuel amount detected by the fuel amount sensor 47 of the fuel tank 11 is greater than the value from the previous detection by an amount greater than or equal to a predetermined amount. However, such determination may be carried out in any other suitable manner. Specifically, the fuel tank 11 may include detection means that detects that the lid of the fill opening of the fuel tank 11 has been opened or closed. It is thus determined whether refueling has been carried out depending on whether the lid has been opened. Alternatively, detection means detecting that a spout of a fuel nozzle has been passed through the fill opening of the fuel tank 11 may be provided. In this case, it is determined whether the refueling has been carried out depending on whether the spout has been inserted through the fuel tank 11.

In the illustrated embodiment, the ethanol concentration of the blended fuel is varied in correspondence with the ethanol concentration of the fuel retained in the fuel tank 11 before refueling and the ethanol concentration of the fuel supplied to the fuel tank 11 through the refueling. The ethanol concentration of the blended fuel changes in the range of 0% (fuel consisting solely of gasoline) to 85%. However, even if the blended fuel is used in the case in which the ethanol concentration changes from 0% to 100% (fuel consisting solely of ethanol), the present invention may be applied to the case in a form similar to the illustrated embodiment.

The alcohol blended with the gasoline is not restricted to the ethanol but may be methanol or isopropyl alcohol.

In the illustrated embodiment, when the engine is re-started and it is detected that refueling has been performed, the fuel pressure switch valve 33 in the low-pressure return pipe 31 is operated to open. This restricts returning of the fuel from the delivery pipes 14R, 14L to the fuel tank 11 through the high-pressure return pipe 21. In this manner, a certain amount of the fuel from before the refueling is maintained in the delivery pipes 14R, 14L and the main pipe 13. However, such returning of the fuel from the delivery pipes 14R, 14L to the fuel tank 11 may be restricted by lowering the discharge pressure of the fuel pump 12 compared to the level when refueling has not been detected.

In the illustrated embodiment, the restricting procedure that restricts returning of the fuel from the delivery pipes 14R, 14L to the fuel tank 11 is carried out continuously until the total fuel injection amount QTOTAL since starting of the engine exceeds the reference fuel amount QTH, or the amount of the fuel that can be retained in the main pipe 13 and the delivery pipes 14R, 14L when the engine is stopped. However, such restriction may be performed for a predetermined period of time since starting of the engine.

If it is determined that the engine is re-started in a heated state after refueling, the initial learned ethanol concentration value KALCI is set as the learned ethanol concentration value KALC of the fuel. The initial learned ethanol concentration value KALCI is the average of the low-temperature learned value and the high-temperature learned value. The low-temperature learned value is the value that is set when the ethanol concentration ALC has the lowest value throughout the ethanol concentration learning procedure. The high-temperature learned value is the value that is set when the ethanol concentration ALC is the highest. However, the initial learned ethanol concentration value KALCI may be any one of the values from the low-temperature learned value to the high-temperature learned value. Alternatively, the initial learned ethanol concentration value KALCI may be the low-temperature learned value or the high-temperature learned value.

In the illustrated embodiment, if the current starting of the engine is the first cycle of engine starting since refueling and being carried out in the engine heated state, the fuel pressure switch valve 33 is operated to close. This inhibits restriction of returning of the fuel from the delivery pipes 14R, 14L to the fuel tank 11 through the high-pressure return pipe 21. However, such returning of the fuel may be restricted even when the engine is in a heated state. Although the advantage (3) cannot be achieved in this case, the ethanol concentration obtained through the ethanol concentration learning procedure is prevented from becoming significantly different from the actual ethanol concentration. Accordingly, the advantage (1) becomes more pronounced.

If refueling is detected, the fuel pressure switch valve 33 may be operated to open to restrict returning of the fuel from the delivery pipes 14R, 14L to the fuel tank 11 through the high-pressure return pipe 21, regardless of whether the engine is being started. Specifically, refueling may be performed not only when the engine is in a stopped state but also when the engine is operating. Accordingly, the restricting procedure may be started not when the engine is started but when it is detected that refueling has been carried out.

What is claimed is:

1. A fuel injection controller of a flexible fuel internal combustion engine having a main passage through which fuel containing alcohol is fed from a fuel tank to a delivery pipe by a fuel pump, and a return passage through which the fuel is returned from the delivery pipe to the fuel tank, the controller comprising:

an oxygen concentration sensor arranged in an exhaust passage of the engine;

a correcting section that performs a concentration learning procedure in which a concentration of the alcohol of the fuel in the fuel tank is learned as a learned concentration value based on a detection value of the oxygen concentration sensor, the correcting section correcting a fuel injection amount of an injector connected to the delivery pipe in correspondence with the learned concentration value in such a manner that an air-fuel ratio corresponding to a stoichiometric air-fuel ratio is obtained;

a refueling detecting section that detects that refueling has been carried out to the fuel tank; and a restricting section that performs a restricting procedure in which returning of the fuel from the delivery pipe to the fuel tank through the return passage is restricted on condition that the refueling detecting section has detected that the refueling has been performed.

2. The controller according to claim 1, wherein the restricting section continuously performs the restricting procedure from when a first cycle of engine starting is carried out since the refueling detecting section has detected that the refueling has been performed to when a predetermined period of time elapses.

3. The controller according to claim 2, further comprising:

an estimating section that estimates a temperature of the fuel retained in the delivery pipe; and an inhibiting section that inhibits the restricting procedure performed by the restricting section when the temperature of the fuel estimated by the estimating section is greater than or equal to a predetermined temperature.

4. The controller according to claim 3, wherein the correcting section calculates as an initial value a value between a low-concentration learned value set when the alcohol concentration of the fuel has the lowest value and a high-concentration learned value set when the alcohol concentration of the fuel has the highest value throughout the concentration learning procedure, and wherein the controller further includes an initializing section that performs initialization by setting the currently set learned concentration value to the initial value.

5. The controller according to claim 4, wherein the initializing section sets an average of the low-concentration learned value and the high-concentration learned value as the initial value.

6. The controller according to claim 2, wherein, when an integrated value of the fuel injection amount since starting of the engine exceeds an amount of the fuel that can be retained in the main passage and the delivery pipe, the restricting section determines that the predetermined period of time has elapsed and ends the restricting procedure.

7. The controller according to claim 1, wherein the return passage is a high-pressure return passage having a high-pressure regulating valve that regulates a fuel pressure in the delivery pipe to a high pressure, the high-pressure regulating valve configured to open at a predetermined first pressure, the restricting section including:

a low-pressure return passage connected to the main passage, the low-pressure return passage including a low-pressure regulating valve configured to open at a second pressure lower than the first pressure;

a switch valve switching between a state permitting flow of the fuel from the main passage into the return passage and a state inhibiting the flow of the fuel; and a control section that controls the switch valve in such a manner that the flow of the fuel from the main passage to the return passage is permitted on condition that the refueling detecting section detects that the refueling has been carried out.

* * * * *